US009995093B1

(12) United States Patent
Langenes et al.

(10) Patent No.: US 9,995,093 B1
(45) Date of Patent: Jun. 12, 2018

(54) WIRELINE RISER TENSIONER SYSTEM AND METHOD

(71) Applicant: Cameron International Corporation, Houston, TX (US)

(72) Inventors: Harald Langenes, Kristiansand (NO); Alv Repstad, Kristiansand (NO); Jean Philippe Huchon, Kristiansand (NO); Lasse Hammersland, Kristiansand (NO)

(73) Assignee: Cameron International Corporation, Houston, TX (US)

( * ) Notice: Subject to any disclaimer, the term of this patent is extended or adjusted under 35 U.S.C. 154(b) by 0 days. days.

(21) Appl. No.: 15/602,487

(22) Filed: May 23, 2017

(51) Int. Cl.

| | |
|---|---|
| ***E21B 19/00*** | (2006.01) |
| ***E21B 17/01*** | (2006.01) |
| ***E21B 29/12*** | (2006.01) |
| ***E21B 19/09*** | (2006.01) |
| ***E21B 7/12*** | (2006.01) |

(52) U.S. Cl.
CPC ..... *E21B 19/006* (2013.01)

(58) Field of Classification Search
None
See application file for complete search history.

(56) References Cited

U.S. PATENT DOCUMENTS

| | | | | |
|---|---|---|---|---|
| 4,616,708 | A * | 10/1986 | da Mota | E21B 19/006 166/355 |
| 6,691,784 | B1 * | 2/2004 | Wanvik | E21B 19/002 166/346 |
| 9,359,837 | B2 * | 6/2016 | Poehner | E21B 19/002 |
| 2013/0112421 | A1 * | 5/2013 | Pohner | E21B 19/006 166/355 |
| 2016/0185577 | A1 * | 6/2016 | Berry | E21B 19/09 414/800 |
| 2016/0312546 | A1 * | 10/2016 | Bourgeau | E21B 19/06 |

* cited by examiner

*Primary Examiner* — Matthew R Buck
*Assistant Examiner* — Douglas S Wood
(74) *Attorney, Agent, or Firm* — Helene Raybaud

(57) ABSTRACT

A wireline riser tensioner system includes a set of tensioning units arranged about a first well with at least one tensioning cable connected to a first and a second tension ring of the first and second wells, respectively. Both wells can be serviced using the same set of tensioning units. The at least one tensioning cable is routed through a plurality of sheaves. If not being serviced, the first or the second well might serve as an anchor.

13 Claims, 2 Drawing Sheets

WIRELINE RISER TENSIONER SYSTEM AND METHOD

BACKGROUND

This section is intended to introduce the reader to various aspects of art that may be related to various aspects of the present disclosure, which are described or claimed below. This discussion is believed to be helpful in providing the reader with background information to facilitate a better understanding of the various aspects of the present disclosure. Accordingly, it should be understood that these statements are to be read in this light, and not as admissions of prior art.

The present disclosure relates to wireline riser tensioner systems like those used in drilling operations.

A wireline riser tensioner system is designed to provide and maintain the necessary axial tension on a marine riser string as the offshore drilling vessel or rig moves vertically and laterally relative to the wellhead. The system typically includes single or dual tensioner cylinders or units arranged about a wellhead, with the tensioner units connected by way of a wire rope or cable to a tension ring (see FIG. 1). A wire rope or cable is reeved across the tensioner sheaves to provide a desired cylinder stroke-to-vessel heave ratio (e.g., one-fourth of the vessel heave). The cable is routed from the tension ring through an idler sheave, across the respective tensioner, and terminated in an anchor after three safety turns.

Pneumatically, two tensioner cylinders located opposite of each other across the well work together as a pair. The tensioner cylinders have a fluid side and a gas side. The fluid side is between a cylinder piston and a floating piston in a high pressure accumulator. The gas side is on the opposite side of the floating piston in the high pressure accumulator. This arrangement allows the tensioner system to work as a set of large hydraulic-pneumatic springs across the well center.

Using this setup, the tensioners cannot serve a second wellhead unless the tensioners are moved, skidded, or slid into a different location, or unless the tensioners include "direct-acting" cylinders. However, direct-acting cylinders present challenges of their own, and the majority of wireline riser tensioners in new drilling rigs are traditional ones.

SUMMARY

This summary is provided to introduce a selection of concepts that are further described below in the detailed description. This summary is not intended to identify key or essential features of the claimed subject matter, nor is it intended to be used as an aid in determining or limiting the scope of the claimed subject matter as set forth in the claims.

According to some embodiments, a wireline riser tensioner system includes a set of at least two tensioning units arranged about a first well that can apply tension to a tension ring of a second well in addition to that of the first well, thereby eliminating the need to have any tensioning units located about the second well. An operator can select which well is main and which is auxiliary. Both wells can be serviced using the tensioning units.

In embodiments, the tensioning unit may include a single or a dual tensioner, and the set may include some combination of single and dual tensioner units. A wire rope or tensioner cable runs from each tensioner through a plurality of sheaves to the tension ring of the first well and to that of the second well. The tension ring which is not in use may act as the anchor, thereby replacing the three safety turns used in prior art systems. Alternatively, the cable may be anchored in a nearby drillfloor structure. Regardless of how the cable is anchored, the cables from each tensioning unit connect to the tension ring of each well.

In embodiments, the cable may be routed from the tension ring of the first well at an upward angle through an idler sheave (dual or single), across and then down under a respective tensioner, through a turning sheave that directs the cables toward the second well and a second idler sheave that directs the cables angularly downward toward the tension ring of the second well. The cable of those tensioners located nearer the second well may also be routed through a deflection sheave. The turning sheave directs the cable sideways toward the deflection sheave. The deflection sheave routes the cable toward the idler sheave, which then directs the cable angularly downward toward the second well's tension ring.

The system and method of the disclosure enable one set of tensioning units to service at least two wells and, in some embodiments, the well center not in use might be serving as the anchor.

Figure 1:
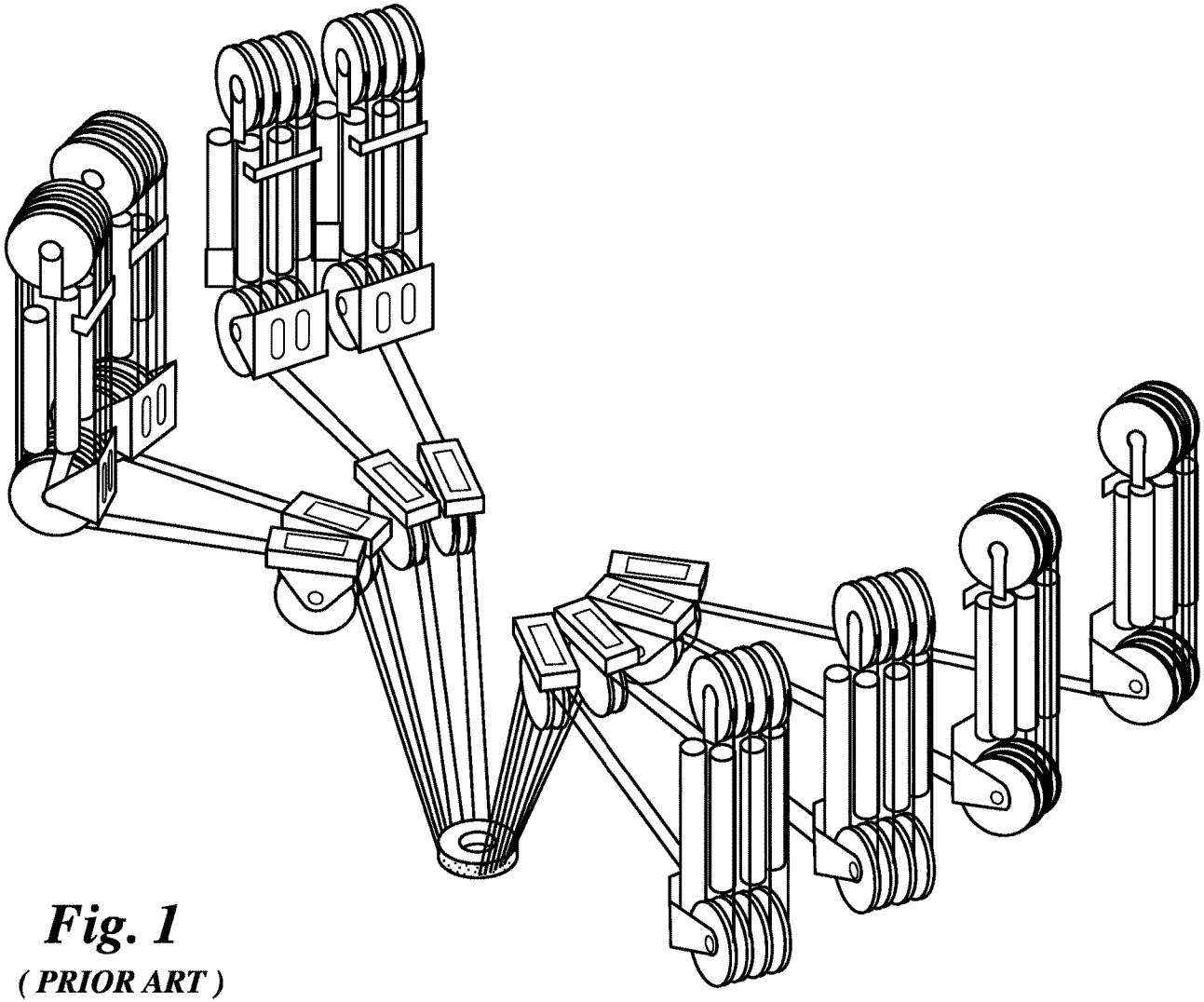
Fig. 1 ( PRIOR ART )
FIG. 1 is an isometric view of a prior art embodiment of a wireline tensioner system. The tensioners are arranged to service a single well. A second set of tensioning units is needed to service a second well or the tensioners must be moved, skidded, or slid to a different location.

The subject disclosure is further described in the following detailed description, and the accompanying drawing and schematic of non-limiting embodiment of the subject disclosure. The features depicted in the figure are not necessarily shown to scale. Certain features of the embodiments may be shown exaggerated in scale or in somewhat schematic form, and some details of elements may not be shown in the interest of clarity and conciseness.

ELEMENTS AND NUMBERING USED IN THE DRAWINGS AND DETAILED DESCRIPTION

10 Wireline riser tensioner system
20 Tensioning units
21 Wire rope or tensioner cable
22 First end of 21
23 Second end of 21
25 Turning sheave
29 Idler sheave
31 Tensioner
33 Tensioner cylinder assembly
35 Fixed sheave or fixed sheave housing
37 Rod sheave or rod sheave housing
40 First well (main or auxiliary)
41 Tension ring
57 Deflection sheave
59 Second idler sheave
70 Second well (auxiliary or main)
71 Tension ring

DETAILED DESCRIPTION

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Figure 2:
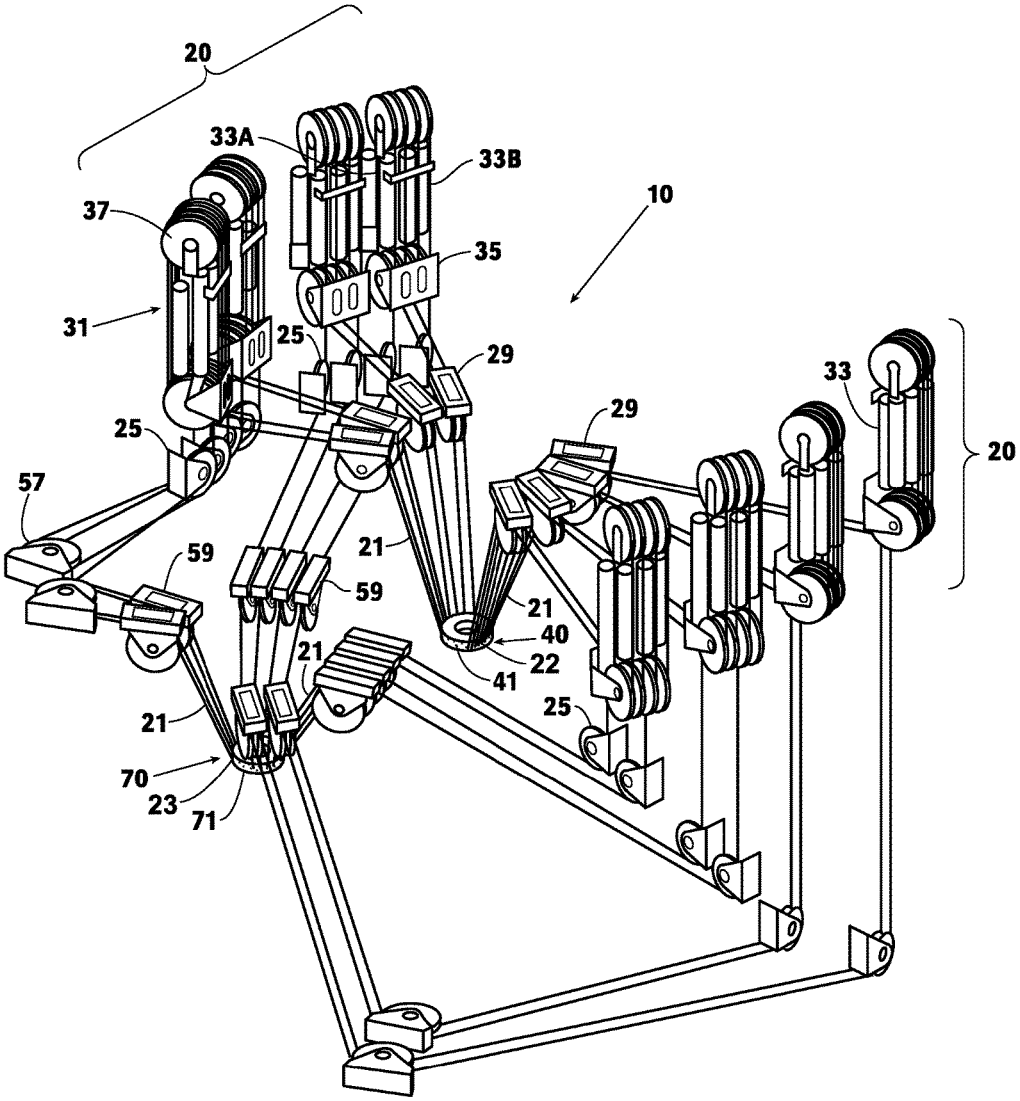
FIG. 2 is an isometric view of an embodiment of a wireline riser tensioner system of the disclosure that can service at least two wells with the same set of tensioners, without any need for movement, skidding, or sliding of the tensioners.

Referring to FIG. 2, an embodiment of an example wireline riser tensioner system 10 provides at least two tensioning units 20 arranged about a first well 40 that enables service of at least a second well 70 without the need to use direct-acting cylinders or without the need for a second set of tensioning units or the need to move, skid, or slide the tensioners 20 to a different location. The tensioning units 20 may include any tensioner suitable for application-specific requirements and may be dual tensioners 31, such as a CAMERON® DUAL 250 KIPS™ tensioner or its equivalent. Single tensioners also may be used.

Using one tensioning unit 20 as an example, the tensioners 31 may include left-hand and right-hand tensioner cylinder assemblies 33A & B mounted to a fixed sheave housing 35 which, in turn, is fixed (for example, bolted) to a drillfloor structure. The fixed sheave housing 35 includes one or more sheaves that are used to obtain a desired ratio between the cylinder stroke and the vessel heave. In embodiments, a rod sheave housing 37 is attached to each cylinder assembly 33 and is free to move relative to the fixed sheave housing 35. Forces induced to the tensioners 31 by the wire pull might be taken by the fixed sheave housing 35, with some horizontal forces taken by a guiding bracket connected to the upper part of each of the cylinder assemblies 33.

A set of wire ropes or tensioner cables 21 has a first end 22 connected to a tension ring 41 of a first well 40 and a second end 23 connected to a tension ring 71 of a second well 70 (i.e., in this arrangement, the same cable 21 goes from the first well 40 to the second well 70). In applications wherein the cable 21 is terminated in either tension ring 41 or 71, the ring not in use might serve as an anchor. The cable's terminating end 22 or 23 might change depending on whether the first or second well 40, 70 is selected by, for example, a control system (not shown) of a known kind used to control and monitor elements of a wireline riser tensioner system. The terminating end 22 or 23 may also be connected to a nearby drillfloor structure which then might serve as the anchor.

In embodiments, each cable 21 might run from the first tension ring 41, through a respective idler sheave 29, across to the respective tensioner 31, down under a fixed sheave housing 35 of the tensioner 31, and through a turning sheave 25 and a second idler sheave 59 before it is connected to the second tension ring 71 at the second well 70. For those tensioners 20 lying nearest the second well 70, the cable 21 might also be routed through a deflection sheave 57. As presented on FIG. 2, the turning sheave 25 might direct the cable 21 in a sideward direction toward the deflection sheave 57. The deflection sheave 57 might change the sideways or horizontal direction of the cable 21—e.g., from a first horizontal direction to a second different horizontal direction—and direct the cable 21 toward the second idler sheave 59 before the cable 21 is connected to the second tension ring 71 at the second well.

In an embodiment, regardless of which well 40, 70 is serviced, the set of tensioning units 20 can remain in a same position. In embodiments wherein a diverter (not shown) is installed in both wells 40, 70, the wells 40, 70 might have equivalent functions. An operator can choose, for example, which well 40, 70, is main and which is auxiliary. This arrangement allows for maintenance on the other well's equipment, as well as limits the time required to change main from one well to the other.

An embodiment of a method of the disclosure for servicing at least a main and auxiliary well with a wireline riser tensioner system 10 includes connecting a set of cables from a set of tensioning units 20 located about a first well 40 to two tension rings: the tension ring 41 of the first well and the tension ring 71 of a second well 70; selecting one of the wells 40 or 70 as main; and then actuating the set of tensioning units 20. The tension ring 41 or 71 of the well 40 or 70 not selected as main may serve as the terminating end, with the cables 21 providing and maintaining an axial tension on the marine riser string of the well 40 or 70 as the vessel moves vertically and laterally relative to the well 40, 70.

While the disclosure may be susceptible to various modifications and alternative forms, embodiment have been shown by way of example in the drawing and have been described in detail herein. However, it should be understood that the disclosure is not intended to be limited to the particular forms disclosed. Rather, the disclosure is to cover all modifications, equivalents, and alternatives falling within the spirit and scope of the disclosure as defined by the following appended claims.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for" or "step for" performing a function, it is intended that such elements are to be interpreted under 35 U.S.C. 112(f). However, for any claims containing elements designated in any other manner, it is intended that such elements are not to be interpreted under 35 U.S.C. 112(f).

What is claimed:

1. A wireline riser tensioner system comprising:

at least two tensioning units arranged about a first well, each of the at least two tensioning units including at least one tensioner and at least one tension cable with a first end connected to a first tension ring of the first well and a second end connected to a second tension ring of a second different well;

wherein the first tension ring is fixed to a riser associated with the first well and the second tension ring is fixed to a riser associated with the second different well.

2. A wireline riser tensioner system according to claim 1 wherein the first or the second end of the at least one tension cable is an anchored end.

3. A wireline riser tensioner system according to claim 1 wherein the at least one tension cable is routed through a plurality of sheaves located between the first and second tension rings.

4. A wireline riser tensioner system according to claim 3 wherein a portion of the at least one tension cable is routed through a deflection sheave arranged to change a direction of the at least one tension cable.

5. A wireline riser tensioner system according to claim 1 wherein the set of tensioning units remains in a substantially same position when the first well and/or when the second different well is/are being used.

6. A wireline riser tensioner system according to claim 1 wherein the set of tensioning units includes dual tensioners.

7. A wireline riser tensioner system according to claim 1 wherein the set of tensioning units includes single tensioners.

8. A wireline riser tensioner system comprising:

at least two tensioning units arranged about a first well, each of the at least two tensioning units including at least one tensioner and at least one tension cable with a first end connected to a first tension ring of the first well and a second end connected to a second tension ring of a second different well, the at least one tension cable being routed through a plurality of sheaves located between the first and second tension rings;

wherein the first tension ring is fixed to a riser associated with the first well and the second tension ring is fixed to a riser associated with the second different well.

9. A wireline riser tensioner system according to claim 8 further comprising a deflection sheave arranged to change a direction of the at least one tension cable.

10. A method for servicing a first well and/or a second different well using at least two tensioning units arranged about the first well or second different well and one tension cable connected to a first and a second tension ring of the first well and the second different well, respectively, the method comprising:

selecting the first well or second different well to be a main well;

actuating the set of tensioning units and the at least one tension cable to provide an axial tension on a marine riser string of the main well;

wherein the first tension ring is fixed to a riser associated with the first well and the second tension ring is fixed to a riser associated with the second different well.

11. A method according to claim 10 further comprising anchoring the at least one tension cable in the first or second tension ring of the first well or second different well that is not the main well.

12. A method according to claim 10 further comprising anchoring the at least one tension cable in a drillfloor structure.

13. A method according to claim 10 wherein the at least two tensioning units remains in a substantially same position regardless of the first well or second different well being selected as the main well.

* * * * *